US008031035B2

(12) United States Patent
Chernyakov et al.

(10) Patent No.: US 8,031,035 B2
(45) Date of Patent: Oct. 4, 2011

(54) CIRCUIT CONFIGURATION

(75) Inventors: Alexander Chernyakov, Munich (DE); Georgiy Sevskiy, Munich (DE); Patric Heide, Vaterstetten (DE); Borys Vorotnikov, Munich (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 12/900,208

(22) Filed: Oct. 7, 2010

(65) Prior Publication Data

US 2011/0074521 A1 Mar. 31, 2011

Related U.S. Application Data

(63) Continuation of application No. PCT/EP2009/054903, filed on Apr. 23, 2009.

(30) Foreign Application Priority Data

Apr. 24, 2008 (DE) ..... 10 2008 020 597

(51) Int. Cl.
*H01P 1/203* (2006.01)

(52) U.S. Cl. ..... 333/203; 333/134; 333/204; 333/219

(58) Field of Classification Search ..... 333/134, 333/204, 185, 203, 219
See application file for complete search history.

(56) References Cited

U.S. PATENT DOCUMENTS

| | | | | |
|---|---|---|---|---|
| 5,489,881 | A * | 2/1996 | Yuda et al. | 333/203 |
| 6,115,264 | A | 9/2000 | Nosaka | |
| 6,265,954 | B1 * | 7/2001 | Krause | 333/204 |
| 6,304,156 | B1 | 10/2001 | Ishizaki et al. | |
| 6,597,259 | B1 * | 7/2003 | Peters | 333/134 |
| 6,696,903 | B1 | 2/2004 | Kawahara et al. | |
| 7,432,786 | B2 * | 10/2008 | Tomaki et al. | 333/204 |
| 7,663,455 | B2 | 2/2010 | Goi et al. | |
| 2003/0085780 | A1 | 5/2003 | Wang | |
| 2003/0117234 | A1 | 6/2003 | Shingaki et al. | |
| 2007/0120627 | A1 | 5/2007 | Kundu | |
| 2010/0073108 | A1 * | 3/2010 | Yamasita et al. | 333/204 |

FOREIGN PATENT DOCUMENTS

| | | | |
|---|---|---|---|
| EP | 0 926 933 | A1 | 6/1999 |
| EP | 1 855 349 | A1 | 11/2007 |
| JP | 2005-159512 | A | 6/2005 |

OTHER PUBLICATIONS

Heide, P., et al., "Highly-Integrated LTCC Frontend-Modules for Bluetooth and Wireless-LAN Application," European Microwave Week, ECWT, Oct. 2003, 4 pages, Munich, Germany.

Chernyakov, A., et al., "Novel Samll-Size LTCC-Based WLAN Frontend-Modules with Integrated Power Amplifiers," WE6A-4, MTT-S Digest, 2004, pp. 559-562, IEEE.

Huang, C.-W. P., et al., "A Compact High Rejection 2.4 GHz WLAN Front-End Module Enables Multi-Radio Co-existance UP to 2.17 GHz," 2006, 4 pages, IEEE.

* cited by examiner

*Primary Examiner* — Seungsook Ham
(74) *Attorney, Agent, or Firm* — Slater & Matsil, L.L.P.

(57) ABSTRACT

A ceramic multilayer construction includes three resonators designed as parallel strip lines that are capacitatively or magnetically coupled to each other. All circuit components are implemented in the form of metallizations in multilayer construction. Capacitative couplings are implemented by coupling capacitors. The strip line resonators are shortened by shunt arms to ground having grounding capacitors arranged therein.

16 Claims, 6 Drawing Sheets

CIRCUIT CONFIGURATION

This application is a continuation of co-pending International Application No. PCT/EP2009/054903, filed Apr. 23, 2009, which designated the United States and was not published in English, and which claims priority to German Application No. 10 2008 020 597.4, filed Apr. 24, 2008, both of which applications are incorporated herein by reference.

TECHNICAL FIELD

The invention relates to a circuit configuration having a filter circuit that is particularly suitable for processing HF signals above two gigahertz, and particularly applicable for WLAN modules.

BACKGROUND

WLAN systems, such as those meeting the 802.11a/b/g standard, are used predominantly in PC applications. An HF filter that passes the desired frequency range and has sufficient suppression in the stop band is needed in both the receiver and the transmitter in these systems. In PC applications, however, it is not generally necessary to achieve a high level of suppression in the stop band.

There is, however, increasing interest in creating cross-system technologies, in particular combining WLAN technology and mobile radio, in order to use VOIP (Voice Over Internet Protocol) and other data transfer functions via cell phone, for example. In the case of integrating WLAN functions in a cellular radio environment for cell phones, a high level of suppression of the mobile radio frequencies is required in order to allow stable coexistence of the WLAN and the mobile radio systems.

Initial attempts to produce WLAN modules integrated in mobile radio systems were built from discrete components, and therefore required a relatively large module surface area.

For attempts using HF filters built using LTCC multilayer technology, there were problems integrating the filters into small, ceramic front-end modules. Discrete filters built based on LTCC technology, in contrast, are typically not compatible with the manufacturing process for LTCC modules. The integration of HF filters in LTCC substrates for front-end modules also causes problems, because the HF filter integrated in the substrate becomes unstable due to the high level of coupling between the LTCC material of the module and the power amplifier.

It is further possible to develop such modules, suitable for WLAN and mobile radio, on the basis of laminate or LTCC technology, and to use discrete components based on LTCC, SAW, or FBAR technology for the corresponding filters. Using these components, good module properties and reliable manufacture can be expected. The disadvantage, however, is the size of such modules, which require relative large module surface area.

SUMMARY

In one aspect, the present invention specifies a circuit configuration having a filter circuit that is simple to produce and that can be implemented at a low component volume.

It is proposed that the circuit configuration is implemented in a ceramic multilayer construction. The construction comprises structured metallization levels separated from each other by ceramic layers. Circuit components that together implement a filter circuit are connected to each other and integrated in the metallization levels.

The filter circuit comprises conductor segments, grounding surfaces, and vias enabling electrical connection between circuit components arranged in different metallization levels. At least parts of the circuit components are capacitatively coupled with each other.

The filter circuit comprises three resonators, designed as strip lines, in the multilayer construction. The resonators are arranged in parallel to each other and are capacitatively and/or magnetically coupled with each other, so that together they cover a passband. The strip lines are preferably arranged in the same metallization level. The resonators, however, can be arranged in different metallization levels. It is further possible to design a single strip line in the form of a plurality of strips parallel to each other that are arranged in the same or different metallization levels and are electrically connected to each other.

In a functional filter circuit, in addition to the resonators designed as strip lines, only additional means allowing the desired coupling of at least two of the resonators to each other are present. For a magnetic coupling, it is sufficient to arrange the strip lines near each other. At least two of the resonators are preferably capacitatively coupled to each other. To this end, the strip lines are connected to each other by means of capacitors designed in the form of metallization surfaces arranged one above the other in different metallization levels. The metallization levels are preferably located directly one above the other in the multilayer construction.

One strip line can be designed as a micro strip line. The line comprises, in addition to at least one signal-carrying strip-shaped conductor, a ground level arranged at a distance to the conductor. It is also possible, however, to design the strip line as a triplate line, in which the strip-shaped conductor is arranged between two ground levels.

In one embodiment of the invention, the ceramic multilayer construction comprises a first and a second ground plane that are preferably implemented in the uppermost and the lowermost metallization levels of the multilayer construction. All further circuit components of the filter circuit can then be arranged between the two ground levels. By arranging the circuit components one above the other in the ceramic multilayer construction, the base surface area required for the circuit configuration can be successfully minimized.

The circuit configuration comprises a signal path that can comprise three resonator connections. A first end of a resonator is connected to each resonator connection. One serial coupling capacitor can be arranged in the signal path before and after each of the resonator connections. The second end of each resonator is connected to ground.

In a further embodiment, at least two of the resonators are each connected at a first end to one resonator connection of the signal path, and at the second end thereof to ground. Furthermore, at each resonator connection, a shunt arm is connected to ground, in which a grounding capacitor is disposed connected to ground. A serial coupling capacitor is arranged in the signal path between every two resonator connections.

By means of the shunt arm, the electrical length of the strip lines can be reduced. In such a design, the length of the strip line resonators can be shortened to less than $\lambda/4$, where $\lambda$ is the wavelength at the resonant frequency of the resonator. The additional circuit components arranged in the shunt arms can be arranged in different metallization levels than the resonators. In this manner, the lateral dimensions of the circuit configuration are further reduced, which is then determined exclusively by the required area and particularly by the length of the strip lines.

All circuit components required for the filter circuit, and particularly the capacitors and their metallization surfaces can be distributed arbitrarily in the multilayer construction. It is particularly possible to arrange the capacitors in metallization levels directly adjacent to those of the strip line or the signal-carrying lines thereof. Each metallization level can comprise a plurality of metallization surfaces assigned to different capacitors. The capacitative coupling of such adjacently arranged metallization surfaces is so minimal that it can be neglected. In this manner, the metallization surfaces required for the capacitors of the filter circuit can be arranged in a minimum number of metallization levels, and connected to each other by means of corresponding vias.

In one embodiment of the invention, two of the resonators are connected to the signal path. A third resonator is arranged between the two resonators, and the first end thereof is directly connected to ground. The other end of the resonator is connected to ground via a grounding capacitor. The third resonator is magnetically coupled with the first and the second resonator. The first and second resonators are capacitatively coupled together, wherein the value of the coupling can be determined by selecting the coupling capacitors correspondingly. Such an arrangement of resonators is referred to as an interdigital arrangement.

In one embodiment of the invention, the signal path comprises three resonator connections arranged one behind the other, each connected to one resonator. One serial connecting capacitor each is arranged ahead of the first and after the third resonator connection in the signal path. A serial coupling capacitor is arranged in the signal path between every two sequential resonator connections. Before the first resonator connection and after the third resonator connection a parallel path is connected to the signal path, in which a further serial coupling capacitor is arranged, by means of which the first and the third resonator are capacitatively coupled with each other. Capacitative couplings can thereby be made between all conceivable pairs of resonators. The sizing of each coupling capacitor can be used to set the degree of coupling. In this manner, a corresponding quantity of poles can be provided in the filter characteristic. The locations can be selected and sized such that the frequency-dependent transfer characteristic comprises sufficient damping at the desired poles. The edge steepness of the passband can also be adjusted by means of the coupling.

The quality of a strip line resonator depends on the cross section of the conductor. Better quality is obtained with a greater cross section.

The strip line or signal-carrying metallization strip is typically produced by pressing a metallization paste on the ceramic green sheets. The height and width of the metallization strips are technologically limited, so that the cross section of an individual strip cannot be arbitrarily increased. It is therefore proposed that individual strips be replaced by at least two strips connected in parallel. The strips can be electrically connected to each other at one or more points, for example, by vias. In this manner, the cross section of the strip lines can be increased without requiring the base area of the multilayer construction to be increased for this purpose. A further advantage can be obtained if the strip line is split up into, for example, two parallel strips that are connected to each other at least at one end, even within the same metallization level. Replacing a normal width strip line by two more narrow split metal strips also has the advantage that the use of the lesser strip width reduces the absolute tolerance in production. Furthermore, such conductors comprise an increased surface area, so that the conductivity of such a conductor, which due to the skin effect depends on the surface area thereof, is increased.

For line segments of the same conductor arranged one above the other, it can be ensured that the spacing between laterally adjacent resonators remains equal even in the case of lateral displacement of adjacent metallization levels, that is, those disposed one above the other. Because the structure is designed so that the edges of a resonator in a first metallization level recedes from all sides relative to the edges in an adjacent metallization level, the spacing of laterally adjacent resonators is always determined by the lateral spacing of corresponding resonator structures (resonator edges) in the second metallization level, which during production remains less than that of the corresponding resonator structures in the first metallization level.

For this purpose, one of the metallization strips arranged one above the other in the indicated second metallization level can be wider than that of the first metallization level, and the more narrow strip can be centered above the wider metallization strips. The same effect can also be achieved if the wider strip is slit longitudinally and the more narrow strip is disposed centered over the slit.

In a further embodiment, a ceramic material having a dielectric constant $\in$ of less than 20 is inserted in the ceramic multilayer construction. The dielectric constant is, however, advantageously even less, for example, less than 15 or even less than 10. A low dielectric constant generates a lesser degree of coupling. In this manner, it is possible to use the multilayer construction as a substrate material for further components of a circuit configuration having further functions. It is particularly possible, for example, to expand the filter circuit by adding a power amplifier that is mounted on the surface of the multilayer construction as a discrete semiconductor element and electrically connected to the filter circuit.

The circuit configuration can further comprise circuit elements that are also designed as discrete semiconductor elements and also mounted on the multilayer construction and electrically connected to the filter circuit or the circuit configuration. In this manner, the multilayer construction can be implemented as a substrate of a complete front end module.

The ceramic multilayer construction, and thus the substrate of the extended circuit configuration, is preferably an LTCC ceramic (Low Temperature Co-fired Ceramic). Such a material is monolithic and has very little lateral shrinkage during sintering, so that structures generated on the green sheet stage, such as metallizations and vias, can be reliably transferred to the sintered, and thus final, structures of the multilayer construction without large lateral dimensional changes.

The circuit configuration can comprise an antenna connection to which the signal path is connected. The filter circuit is arranged in the signal path, for example, between the antenna connection and a semiconductor switching element, at which the common signal path can split into a transmitting path and a receiving path. The transmitting and receiving path can thereby be assigned to a WLAN system. It is also possible to connect to a further signal path by means of the switching element, the path being suitable for transferring signals in the same frequency band. It is thus possible, for example, to provide signal paths in the circuit configuration for WLAN and for Bluetooth, which uses the same frequency band at approximately 2.4 gigahertz.

The WLAN frequencies can be reliably insulated against adjacent mobile radio bands by using the proposed circuit configuration or the filter circuit comprised therein, preferably installed in the signal path on the antenna side. The bands, which are between 800 and 1900 megahertz, for example, can thereby be suppressed by more than 40 dB. The filter circuit further ensures that the mobile radio bands are not negatively affected by the transmitting operation of the WLAN system. It is also thereby possible to suppress the amount of thermal noise generated by the amplifiers of the WLAN system. It is thereby also possible to protect the WCDMA receiving band between 2100 and 2170 megahertz, which is the closest to the WLAN frequencies, against crosstalk from the WLAN frequencies.

BRIEF DESCRIPTION OF DRAWINGS

In the following, the invention is explained in more detail using embodiments and the associated figures.

DETAILED DESCRIPTION OF ILLUSTRATIVE EMBODIMENTS

Figure 1:
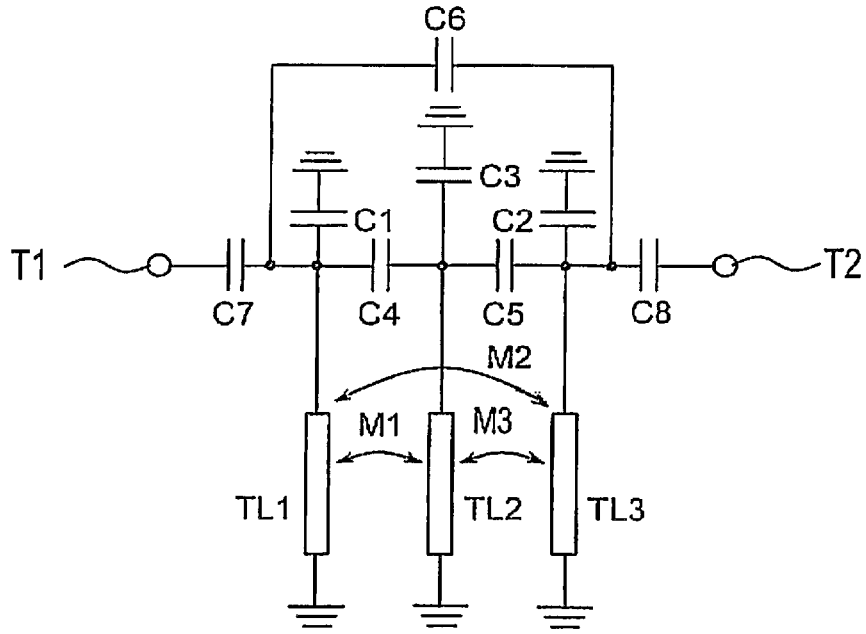
FIG. 1 shows the block diagram of a filter circuit having a comb-like arrangement.

FIG. 1 shows a first embodiment example of a filter circuit according to the invention. The circuit of this embodiment is implemented in multilayer LTCC technology. It comprises essentially three resonators TL1, TL2, TL3, designed as strip lines, also referred to as transmission lines. The strip lines are arranged spatially close and in parallel, so that magnetic couplings M1, M2, and M3 can arise between the individual resonators. In the embodiment shown, the resonators are designed in a comb arrangement. The strip lines are thereby connected to one end of a signal path, which connects a first connection T1 to a second connection T2. The connection point of the strip lines to the signal path is referred to here as the resonator connection.

Coupling capacitors are provided between every two resonator connections, such as a capacitor C4 between the first resonator connection for the first resonator TL1 and the second resonator connection for the second resonator TL2, and a capacitor C5 between the second resonator connection and the third resonator connection for the third resonator TL3. A shunt arm is led to ground from each resonator connection, in that a grounding capacitor being arranged in each shunt arm. A first shunt arm connected to the first resonator connection comprises a first grounding capacitor C1. A second shunt arm connected to the second resonator connection comprises a grounding capacitor C3. A shunt arm having a third grounding capacitor C2 is connected to the third resonator connection. A further capacitative coupling between the first and the third resonator TL1, TL3 is achieved in that a parallel branch ahead of the first resonator connection and after the third resonator connection is connected to the signal path. A coupling capacitor C6 is arranged in the parallel branch.

The strip lines for the three resonators can be substantially shorter than known strip line resonators, by using the grounding capacitors in the shunt arms to ground. The filter circuit can also be implemented in a ceramic material having a relatively low dielectric constant and in acceptable dimensions. Coupling and grounding capacitors are thereby arranged above and below the resonators in the multilayer construction, so that the lateral dimensions of the circuit configuration shown are substantially determined by the length of the strip lines. The combinations of capacitative and magnetic coupling generate a plurality of poles, allowing targeted adjustment of the transmission curve, with regard to edge shape and suppression of critical frequencies.

The multilayer construction is completed by two ground levels that are part of the transmission lines or strip lines, and between which are disposed all circuit components, particularly the metallization surfaces for grounding and coupling capacitors and the vias for connecting the circuit components. If vias are necessary for connecting circuit components through a plurality of the ceramic layers, then the connections are preferably arranged directly one above the other. The vias are implemented near the circuit components for optimal utilization of the lateral dimensions.

Figure 5:
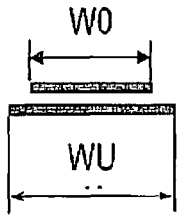
FIGS. 5 and 6 (including FIG. 6A and FIG. 6B) show examples of embodiments of strip lines in cross section and in plan view.

A strip line or transmission line is composed of at least one signal-carrying line of a given electrical length of a ground line led in parallel to a ground line, particularly a ground level. The signal-carrying line, in turn, can be split horizontally in order to increase its cross-sectional area, and can comprise additional segments arranged in different but directly adjacent metallization levels. FIG. 5 shows a simple embodiment of such a strip line extending in two metallization levels, for example the signal-carrying segment thereof. The segment comprises an upper strip having a width WO, and a lower strip having a width WU, wherein WO is less than WU. The more narrow upper conductor segment is preferably arranged centered above the wider lower line segment. A lateral relative displacement of the two conductor segments is thereby insignificant to the resonator properties, because due to the centered arrangement and the different widths the overlapping surface remains unchanged until the upper strip segment is displaced over the edge of the lower strip segment.

Figure 6A:
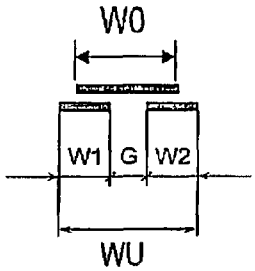
Figure 6B:
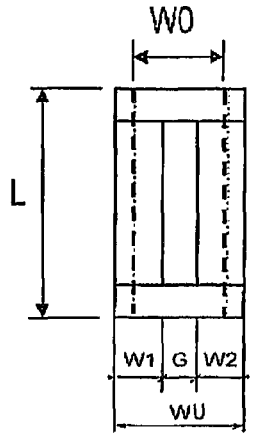

FIG. 6A shows a further embodiment, in which the lower strip segment is slit in the center, and thus is composed of two parallel partial strips extending within the same metallization level. The distance of the two outer edges of the two partial strips facing away from each other is WU, and the width of the upper strip is WO, where WO is less than WU. Here again, due to the central arrangement of the upper strip centered above the two lower partial strips, it is ensured in the case of lateral displacement that the overlapping surface area remains constant up to a particular extent of lateral displacement. FIG. 6B shows a plan view of the slitted, multi-strip conductor shown in FIG. 6A. The two partial strips arranged in a common metallization level have a length L, and are electrically connected to each other at both ends via shunts. The upper and lower partial strips are also electrically connected to each other at least at one end, preferably at both ends.

Figure 7:
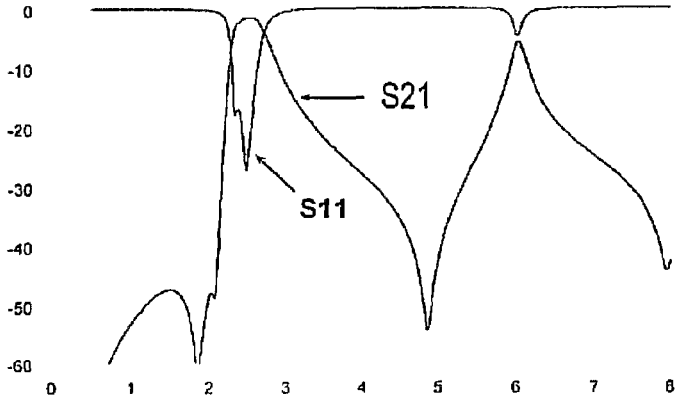
FIG. 7 shows the transfer curve of a filter circuit according to the invention.

FIG. 7 shows the transfer curve of a filter circuit designed according to FIG. 1. The pass band, which is determined by the resonant frequencies of the strip line resonators and thus by the electrical length L thereof, is at approximately 2.4 to 2.5 gigahertz here, corresponding to the bandwidth of a first WLAN system. It can be seen that, particularly toward lower frequencies in which the transmission bands of various mobile radio systems are disposed, high damping of 45 dB and more is achieved. The filter circuit is therefore exceptionally well suited for insulating a WLAN system against a mobile radio system preferably installed in the same housing, so that parallel WLAN and mobile radio operation is possible in the mobile radio device.

Figure 2:
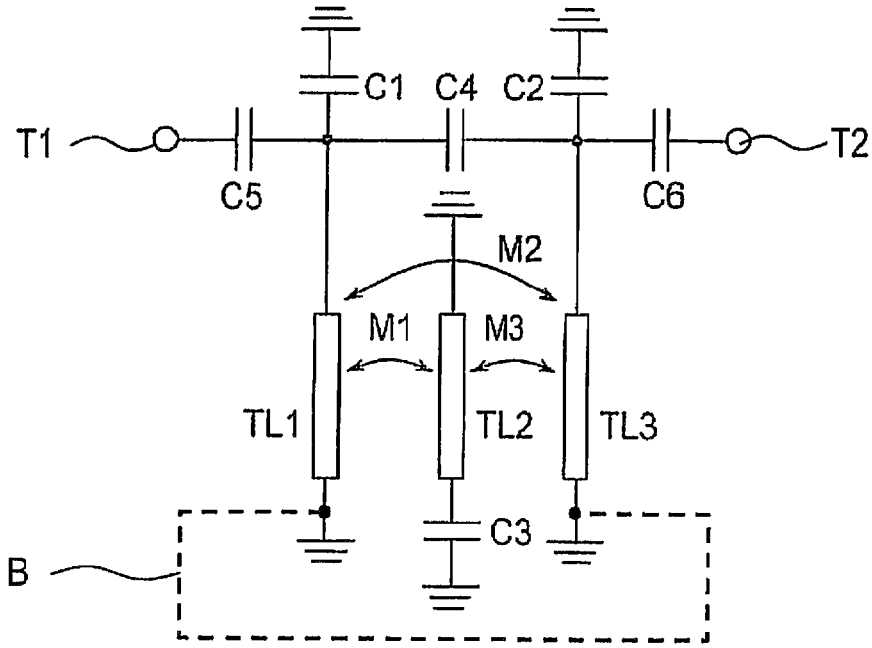
FIG. 2 shows the block diagram of a filter circuit having an interdigital arrangement.

FIG. 2 shows a further embodiment of a filter circuit according to the invention, in which three resonators designed as strip lines are arranged in parallel to each other. In contrast to the embodiment according to FIG. 1, however, only two of the resonators here are connected by means of resonator connections to the signal line extending between the connections T1 and T2. A third strip line resonator TL2 is disposed centrally between the first and second resonator, but is not electrically connected thereto or to the signal line. The resonators are connected to ground at the end facing away from the signal line. One shunt arm to ground having a grounding capacitor C1, C2 arranged thereon is connected to each of the resonator connections.

The third resonator TL2, arranged between the first and second strip line resonators TL1, TL3, is connected directly to ground at one end, and is connected to ground via a capacitor C3 at the other end. Due to the spatial proximity to the first and second resonator, it can couple to the resonators magnetically. The couplings M are shown by double arrows.

A further detail of the arrangement is a bridging line B that can selectively connect the ground-side ends of the first and second resonator TL1, TL3 to each other. The connection B can be implemented in a metallization level in the form of a conductor, arranged above the strip lines. By means of the bridge line, it is possible to further improve the insulation at particular locations of the transfer function. Instead of only one bridging line B, further bridge lines can be provided, which are all connected to each other in parallel. In this manner, the ground connection at the short circuit end of the resonators is improved. A connecting capacitor C5 can be arranged in the signal path between the end of the signal line T1 and the first resonator connection, and a second connecting capacitor C6 can be arranged in the signal path between the second resonator connection and the second end of the signal line T2.

Figure 8:
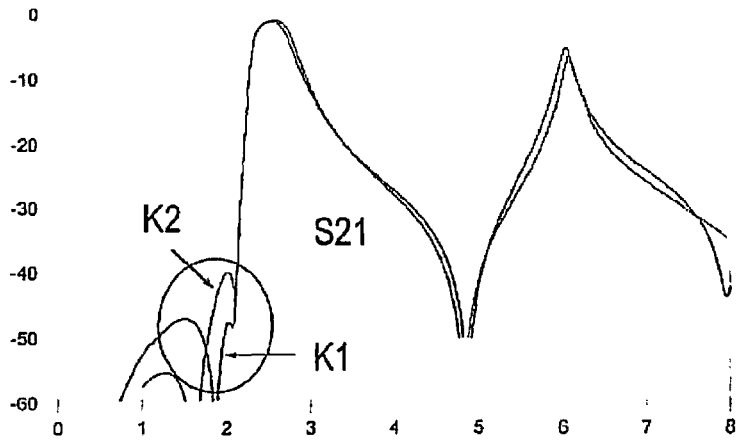
FIG. 8 shows the effect of an additional bridge at the ground-side end of the strip line, using two transfer curves.

FIG. 8 shows the transfer curve K1 for a filter circuit designed according to FIG. 2, compared to a second transfer curve K2 that, in contrast, does not include the bridge line B. It is evident that significantly better insulation can be achieved near the stop band by means of the bridge line B than without the bridge line. With the bridge line B, a pole is created just below the passband, leading to a steeper flank and therefore better insulation against mobile radio bands located in the range, such as the WCDMA band. In the other band ranges, the transfer curve remains nearly unchanged due to said additional bridge line.

Figure 9:
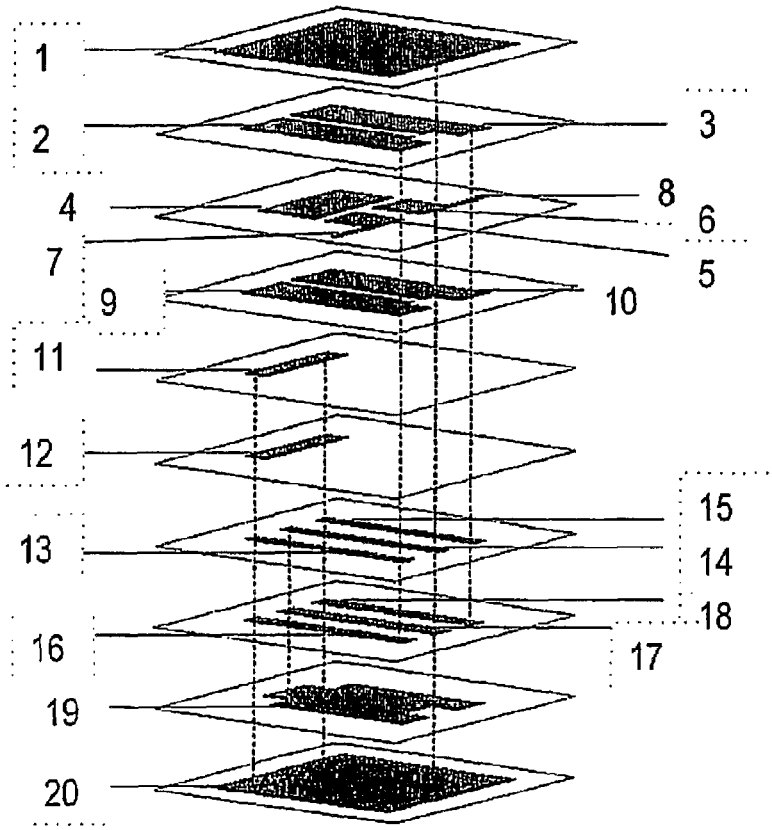
FIG. 9 shows an example of metallization for a filter circuit according to FIG. 2.

FIG. 9 shows a layout drawing of a potential embodiment of the filter circuit according to FIG. 2 in a multilayer construction. Shown are the individual ceramic layers, spaced apart from each other, and the metallizations arranged between the ceramic layers that implement the circuit components of the filter circuit from FIG. 2. The metallization 1 on the uppermost ceramic layer and the metallization 20 on the lowest ceramic layer of the multilayer construction represent grounding levels. All other circuit components that are implemented in the form of structured metallizations are arranged between the two metallization levels.

Capacitors or capacitances are implemented by metallization surfaces lying one above the other and at least partially overlapping each other. For example, the grounding capacitor C3 (from FIG. 2) is formed by the two metallization surfaces 19 and the grounding level 20. The grounding capacitors C1 and C2 are each formed by the grounding level 1 and one of the two metallization surfaces 2 and 3. The three resonators TL1, TL2, and TL3 implemented as strip lines are implemented in the figure as metal strips each connecting two electrical vias to each other and arranged in different metallization levels. Resonator TL1, for example, comprises strips 13 and 16, resonator TL2 comprises strips 14 and 17, and resonator TL3 comprises strips 15 and 18. The capacitative coupling by means of the coupling capacitor C4 is formed by the metallization surface 4, arranged both between the metallization surfaces 2 and 9 and between the metallization surfaces 3 and 10. The connecting capacitor C5 is formed by the capacitance between the metallization surfaces 5 and 2, while the connecting capacitor C6 is formed by the capacitance between the metallization surfaces 5, 2, and 9, and the connecting capacitor C6 is formed by the capacitance between the metallization surfaces 6, 3, and 10. The grounding capacitor C1 is formed by metallization surfaces 1 and 2, and the grounding capacitor C2 is formed by metallization surfaces 1 and 3. The resonators TL1 through TL3 are each designed, for example, as shown in FIG. 5. Further important details of the structure are the bridge lines B, implemented in the form of metal strips 11 and 12 in FIG. 9 and connecting the ground-side ends of the resonators TL1 and TL3 to each other. The two strips 11 and 12 are electrically connected in parallel and are connected to the strip lines or resonators by vias.

The example further shows that it is not necessary to arrange additional ceramic layers between the resonators and the coupling resonators or the metallization surfaces thereof. It is also evident that circuit components in the form of metallizations can be provided between the signal-carrying lines of the resonators and the grounding surface (grounding surface 20 here) required for a micro strip line, without the components disturbing the function of the filter circuit. The additional metallization levels 19 between the grounding surface 20 and the resonator strips in the metallization level above simply causes the impedance level not to be defined.

The electrical connection of the filter circuit from FIG. 9 corresponds to the connections T1 and T2 in FIG. 2, and can be made by means of the metallization strips 7 and 8. It is also possible by means of the invention, as is clearly evident in FIG. 9, to arrange a plurality of metallization surfaces associated with different capacitors next to each other in one metallization level, without the surfaces negatively influencing each other. In this manner, a compact design of the multilayer construction is created, and thus a component implementing the filter circuit is created having minimized dimensions.

The concept according to the invention does not prevent integrating further ceramic layers in the multilayer construction, which can be free of metallization or can contain additional metallizations, and thus additional circuit components that can be connected to the filter circuit or that can be associated with other functions of the circuit configuration. In particular, discrete components mounted on the multilayer construction as a substrate and connected to the filter circuit in the multilayer construction can be added to the circuit configuration.

To the extent that the sum of the lateral dimensions of the discrete components used in the circuit configuration exceeds the base area of the multilayer construction shown in FIG. 9, the compact construction can be somewhat equalized in that metallization surface arranged here in different metallization levels, or one above the other, can be arranged adjacent to each other in fewer overall metallization levels. It is, however, advantageous if metallizations connected to circuit components can be connected to each other by vias running vertically through the multilayer construction, without requiring horizontally running conductor terminations.

For insulations, one or more additional ceramic layers can be arranged as the uppermost layer of the multilayer construction. It is also possible in principle, however, to enlarge the base area of the uppermost ceramic layer having the grounding level 1 so that the surface of the uppermost ceramic layer not covered by the grounding surface 1 is available as a substrate for mounting discrete components.

Figure 3:
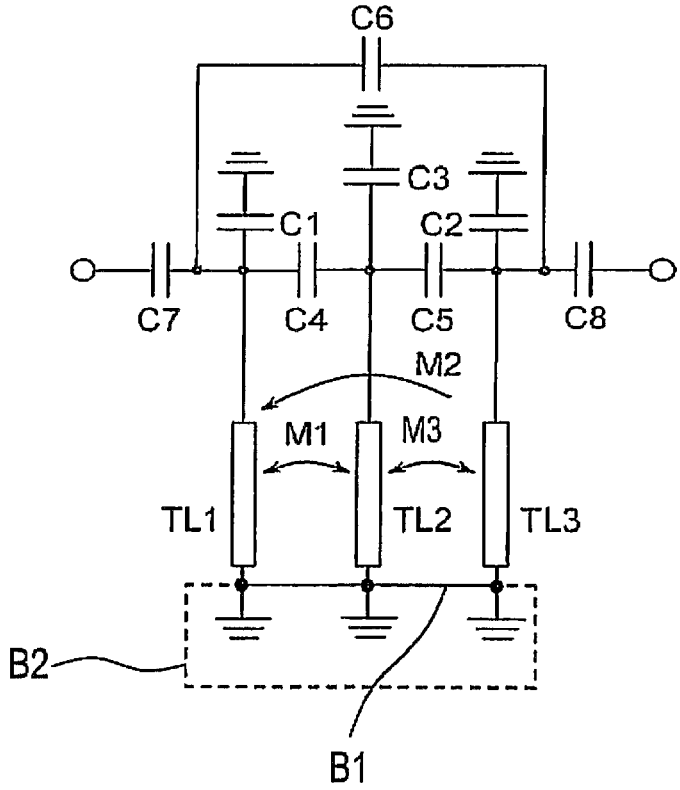
FIG. 3 shows the block diagram of a further filter circuit in a comb-like arrangement, in which the resonators are bridged on the ground side.

FIG. 3 shows the block circuit diagram of a filter circuit having a comb-like arrangement of three parallel resonators TL1, TL2, and TL3 implemented in the form of strip lines. The construction thereof differs from that shown in FIG. 1 by the bridging line B1, which connects the ground-side ends of the three resonators to each other in the same metallization level. A further bridging line B2 can be optionally provided, connecting the ground-side ends of the two outer resonators TL1 and TL3 to each other, wherein the bridging line B2, however, is designed in a metallization level arranged above or below. The improvements explained using FIG. 8 with regard to insulation below the pass band are also achieved in this embodiment.

Figure 4:
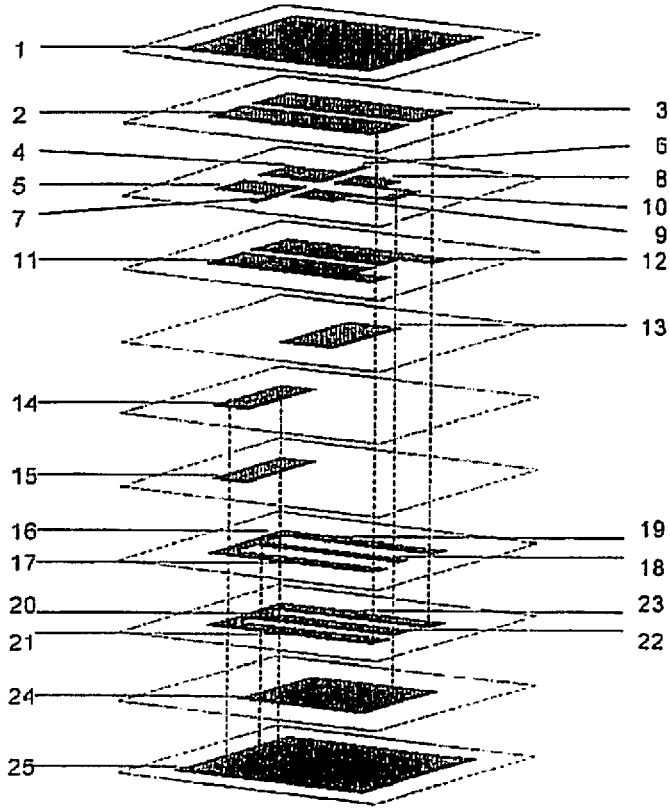
FIG. 4 shows an example of metallization for a filter circuit according to FIG. 3.

FIG. 4 shows the structure of a potential multilayer construction by means of which the filter circuit shown schematically in the block diagram of FIG. 3 can be implemented in the form of concrete metallizations and ceramic layers. The form of the illustration corresponds to that of FIG. 9, explained above. A substantial difference of the structure in FIG. 4 from the structure from FIG. 9 is the bridging line B1, which connects the three strip-shaped resonators to each other on the ground side in the same metallization level as the strip lines. Each of the three resonators TL1 through TL3 is implemented again by two metallization strips disposed one above the other as depicted in FIG. 5, connected to each other here at both ends. The three resonators are thus composed of pairwise strips 17 and 21, 18 and 22, and 19 and 23. The coupling capacitors C1 and C2 are formed by the grounding levels 1 and 2, and 3 and 1, respectively. The grounding capacitor C3 is formed by the grounding surfaces 24 and 25. The coupling capacitors C4 and C5 are formed by the grounding surfaces 9 and 8, arranged between grounding levels 2 and 11, and 3 and 12, respectively. Grounding surfaces 2 and 11, and 3 and 12, are each connected to each other by means of vias, so that the coupling capacitors C4 and C5 each are composed of two capacitors connected in parallel. The capacitative coupling of two adjacent metallization surfaces by means of a further, larger metallization surface overlapping the two first metallization surfaces has the advantage that, for a given capacitance, the base area required in the multilayer construction can be reduced. As an alternative, of course, it is also possible to implement the capacitors by only two overlapping metallization surfaces each, which then naturally comprise a larger required area. The coupling capacitor C6 consists of the metallization surfaces 11, 13, and 12, connected capacitatively in cascade. The connecting capacitors C7 and C8 comprise metallization surfaces 5 and 2, and 4 and 3, respectively.

Here again, a bridging line B2 is implemented by the metallization strips 14 and 15 connected in parallel, which are connected to the ground-side ends of the resonators TL1 and TL3 by means of vias.

FIG. 7 shows the transmission curves of the filter circuit shown in FIG. 4, which corresponds to the block circuit diagram from FIG. 3. The transmission curve S21 shows two poles below the passband, near two gigahertz. The poles result from the combination of magnetic and capacitative coupling between the resonators. Whereas the capacitative coupling is determined by the overlapping area of the corresponding metallization surface, the spacing thereof, and the dielectric constant of the intermediate ceramic layer, the magnetic coupling is a function of the spacing of the strip lines. The couplings M1 and M3 of the two outer strip line resonators to the center strip line resonator, together with the coupling capacitors C4 and C5, define the poles near the passband. The magnetic coupling M2 between the two outer strip line resonators defines the further pole, shown on the far left in the illustration, which also lies below the passband. An increase in the distance between resonators would change the magnetic couplings M1 through M3, and thus the position of the poles. In this context, the bridging lines B2, the metallization strips 14 and 15 between the ground-side ends of the first and third resonators TL1, TL3 in FIG. 4, serve for adjusting the magnetic coupling M2 independently of the magnetic couplings M1 and M3. A change in the coupling can be achieved by changing the strip width and number of bridging strips. The bridging strips can also be arranged below the strip lines, or both above and below. The connecting lines B1 corresponding to the strip-shaped metallizations 16 and 20 in FIG. 4 create an additional magnetic coupling between the resonators TL1 and TL2, TL2 and TL3, and TL1 and TL3. Depending on the desired filter characteristics, the metallization strips 16 and 20 may also be eliminated.

Figure 10:
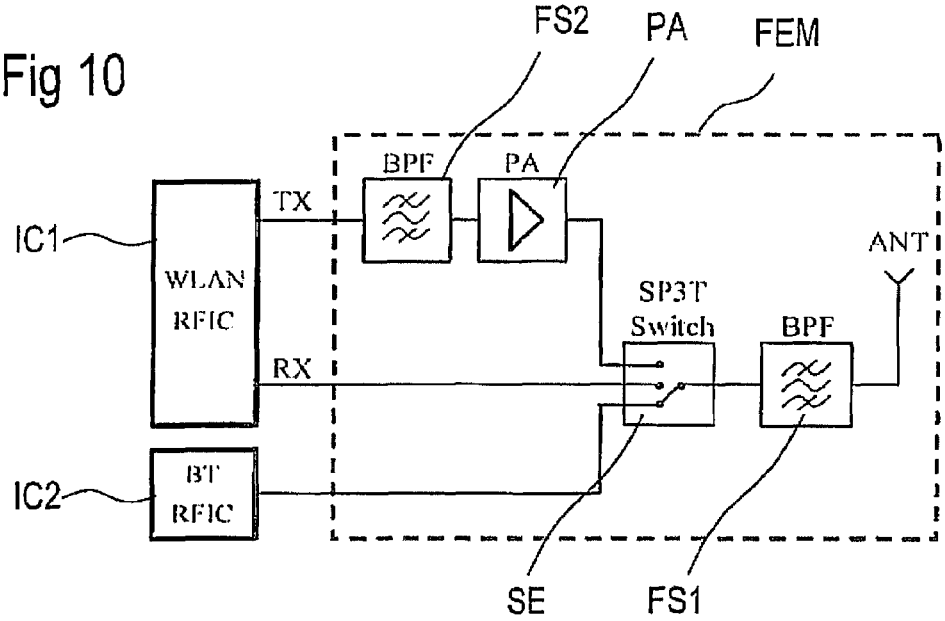
FIG. 10 shows a block diagram for a front end module having a filter circuit.

FIG. 10 shows the further embodiment of a proposed circuit configuration, comprising the circuit components integrated in the multilayer construction and discrete components mounted on the multilayer construction. All circuit component arranged within the dashed line are considered part of the circuit configuration. The circuit configuration from FIG. 10 comprises an antenna connection directly connected to a first filter circuit FS1, designed according to the invention. The filter circuit is further connected to a switching element SE that can selectively connect the signal path, which has been unitary until now, to three partial signal paths. The signal path shown at the bottom of the figure is a transmitting/receiving path for a Bluetooth system, and is connected to a corresponding transceiver IC2 on the output side (shown on the left in the figure). The signal path in the center of the figure corresponds to the receiving path of a WLAN system, and leads from the switch directly to a transceiver IC1. A second filter circuit FS2 is arranged in the uppermost partial path, corresponding to the transmitting path of the WLAN system, between the transceiver IC1 and the switching element SE, and a power amplifier PA is arranged between the filter circuit and the switching element SE.

Figure 12:
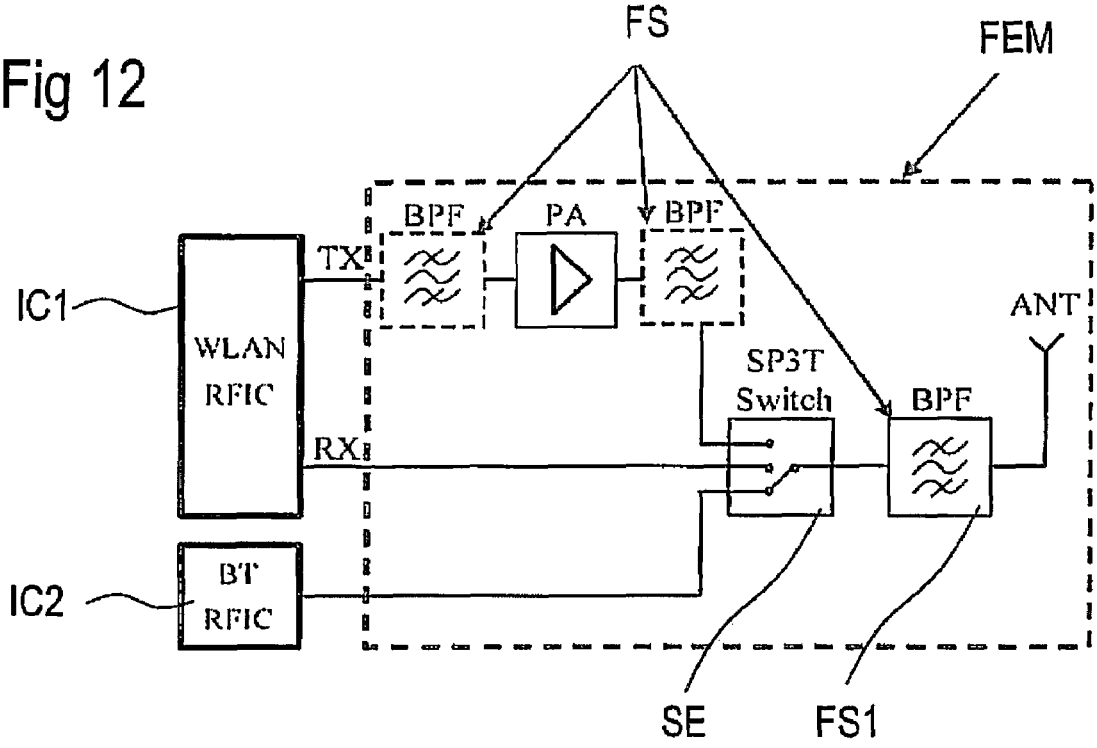
FIG. 12 shows a block diagram for a simple embodiment of a front end module of a WLAN system.

In a further variant of the circuit configuration, according to FIG. 12, a further filter circuit designed according to the invention is arranged in the upper partial path between the power amplifier PA and the switching element SE. The dashed depiction in FIG. 12 for the two filter circuits of the upper partial path indicates that the circuits are both optional, and are not absolutely required for the functioning of the overall circuit configuration designed as a front end module FEM, because the filter functions thereof as passband filters are already fulfilled by the first filter circuit FS1.

Figure 11:
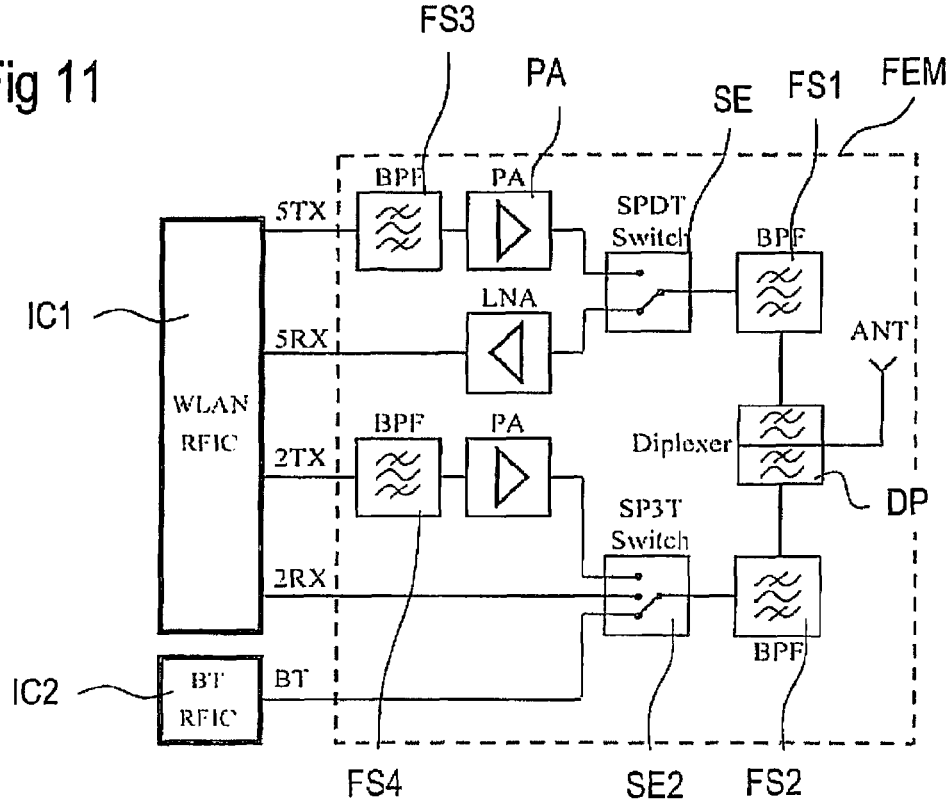
FIG. 11 shows a block diagram for a front end module which operates at two WLAN frequency bands.

In a further embodiment, the circuit configuration designed as a front end module FEM according to FIG. 11 comprises a diplexer DP on the antenna side, dividing the antenna connection into two signal paths. A first filter circuit FS1 connected to a switching element SE is first arranged in the upper signal path. The switching element selectively connects the filter circuit FS1 to a transmitting path TX or a receiving path RX. One amplifier PA or LNA is arranged in each of the two paths on the switch side. A third filter circuit FS3 can be arranged in the transmitting path between the transceiver IC1 and amplifier PA. The second signal path separated at the diplexer DP, shown at the bottom of FIG. 11, corresponds to a circuit configuration as previously explained using FIG. 10. By means of a second switching element SE2 downstream of the filter circuit FS2 acting as a passband filter on the input side, the signal path is divided into three partial paths, one transmitting/receiving path for Bluetooth, leading to a transceiver IC2, and a transmitting path TX and a receiving path RX for a second WLAN frequency range. Because the two frequency ranges permitted for WLAN are sufficiently separated from each other, at 2.4-2.5 and 4.9-5.85 GHz, one diplexer DP comprising a high-pass and a low-pass is sufficient for separating the signals for the different WLAN frequency bands. Here again, the third and fourth filter circuits FS3, FS4, arranged in each transmitting path of the two WLAN systems, can optionally be eliminated.

The invention is not limited to the embodiments shown in the figures. Potential implementations in the form of circuit components implemented as metallizations can be varied as needed, and can comprise a further quantity of circuit components as well. The circuit configuration is particularly intended for WLAN systems and other wireless communication and data transfer systems, but is not limited to the systems. The proposed circuit configuration can also be implemented at other frequency ranges and passbands, and can be used for correspondingly differentiating between two different frequency bands. The circuit configuration according to the invention and the filter circuit present therein is, however, advantageously used for selecting high-frequency frequency bands as opposed to lower-frequency adjacent bands, due to the steep lower flank of the passband, particularly because the right flank of the passband is not as steep in design as the right, and the selectivity relative to higher frequencies is accordingly lower.

What is claimed is:

1. A circuit comprising:

structured metallization levels separated by ceramic layers in a ceramic multilayer construction;

a filter circuit comprising integrated circuit components disposed in the structured metallization levels, wherein the filter circuit comprises conductor segments, grounding surfaces, vias through at least one ceramic layer each, and capacitative couplings; and three resonators designed as strip lines arranged in parallel to each other in the multilayer construction, the resonators being capacitatively and/or magnetically coupled to each other so that they span a passband;

wherein each of the resonators comprises a first metallization stripe and a second metallization stripe that are parallel to each and arranged in the same metallization level;

wherein each resonator comprises a third metallization strip arranged above or below the first and the second metallization strips in an adjacent metallization level; and wherein all metallization strips of each resonator are connected to each other at least one end.

2. The circuit according to claim 1, wherein at least two of the resonators are capacitatively coupled.

3. The circuit according to claim 1, further comprising a signal path having three resonator connections, wherein each resonator connection is coupled to a respective one of the resonators.

4. The circuit according to claim 3, wherein each resonator connection is coupled to a first end of the respective resonator and a second end of each resonator is coupled to ground, the circuit further comprising two serial coupling capacitors arranged in the signal path before and after each of the resonator connections.

5. The circuit according to claim 3, wherein a first end of at least two resonators are coupled to each resonator connection of the signal path, wherein a second end of each resonator is coupled to ground, wherein each resonator connection is connected to ground via a shunt arm in which a grounding capacitor is arranged, the circuit further comprising a serial coupling capacitor arranged in the signal path between every two resonator connections.

6. The circuit according to claim 3, wherein a first and a second resonator are connected to the signal path, wherein a third resonator is arranged between the two resonators, a first end of the third resonator being directly connected to ground, and a second end of the third resonator being connected to ground via a grounding capacitor, wherein the third resonator is magnetically coupled to the first resonator and the second resonator.

7. The circuit according to claim 3, further comprising a serial connecting capacitor arranged ahead of the first and after the third resonator connection, a serial coupling capacitor arranged between every two resonator connections, a parallel path having a serial coupling capacitor arranged therein, the parallel path being coupled to the signal path via two connections, wherein the two connections are arranged between each connecting capacitor and the adjacent resonator connection in the signal path.

8. The circuit according to claim 1, wherein a substrate material has a dielectric constant less than 20, the circuit further comprising at least one active semiconductor element mounted on the multilayer construction and electrically connected to the filter circuit, the at least one active semiconductor element comprising at least one amplifier.

9. The circuit according to claim 1, wherein the resonators are designed as micro strip lines, wherein a length of the micro strip lines is less than $\lambda/4$, where $\lambda$ is an electrical wavelength at resonance, wherein the multilayer construction comprises at least one upper and one lower grounding level, and wherein all circuit components of the filter circuit are arranged between the two grounding levels.

10. The circuit according to claim 1, wherein coupling capacitors and grounding capacitors are formed from metallization surfaces arranged in adjacent metallization levels, the adjacent metallization levels being adjacent to the metallization levels having metallization strips in the multilayer construction.

11. The circuit according to claim 1, further comprising at least one coupling or grounding capacitor arranged between metallization strips and a nearest grounding level.

12. The circuit according to claim 1, wherein second ends of each of the resonators comprise metallization strips that are electrically connected to each other in a same metallization level.

13. The circuit according to claim 12, wherein second ends of each of the metallization strips of the first and third resonators are electrically connected to each other via a bridging line, wherein the bridging line is arranged in an adjacent metallization level.

14. The circuit according to claim 1, further comprising an amplifier that comprises an active semiconductor component, the amplifier mounted on the ceramic multilayer construction, which serves as a substrate, wherein the substrate has a dielectric constant less than 15;

wherein the filter circuit comprises an antenna connection to which a signal line is connected; and wherein the amplifier is arranged in a transmitting path of a front end module that comprises a transmitting path having a transmitting input and a receiving path having a receiving output.

15. The circuit according to claim 14, further comprising a switch designed as a discrete semiconductor component mounted on the substrate, the switch configured to selectively couple the filter circuit to the transmitting path or the receiving path.

16. The circuit according to claim 14, wherein the multilayer construction comprises an LTCC ceramic.

* * * * *